US012768245B2

(12) United States Patent
Tao et al.

(10) Patent No.: US 12,768,245 B2
(45) Date of Patent: Oct. 20, 2026

(54) CONTROLLED FLOWBACK FOR STRESS TESTING

(71) Applicant: Schlumberger Technology Corporation, Sugar Land, TX (US)

(72) Inventors: Chen Tao, Sugar Land, TX (US); Keith Nelson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/138,118

(22) PCT Filed: Dec. 21, 2023

(86) PCT No.: PCT/US2023/085414
§ 371 (c)(1),
(2) Date: Jun. 12, 2025

(87) PCT Pub. No.: WO2024/137978
PCT Pub. Date: Jun. 27, 2024

(65) Prior Publication Data

US 2026/0201775 A1 Jul. 16, 2026

Related U.S. Application Data

(60) Provisional application No. 63/476,749, filed on Dec. 22, 2022.

(51) Int. Cl.
*E21B 34/08* (2006.01)

(52) U.S. Cl.
CPC ..... *E21B 34/08* (2013.01)

(58) Field of Classification Search
CPC ..... E21B 34/08
See application file for complete search history.

(56) References Cited

U.S. PATENT DOCUMENTS

| | | | | |
|---|---|---|---|---|
| 10,767,472 | B2 * | 9/2020 | Pfeiffer | E21B 49/08 |
| 2015/0135816 | A1 | 5/2015 | Gisolf | |
| 2015/0361791 | A1 * | 12/2015 | Gisolf | E21B 49/008 166/264 |
| 2019/0368351 | A1 | 12/2019 | Yuratich | |

* cited by examiner

*Primary Examiner* — D. Andrews
(74) *Attorney, Agent, or Firm* — Jeffrey D. Frantz

(57) ABSTRACT

Systems and methods of the present disclosure provide controlled flowback of fluids for stress testing in wireline toolstrings. For example, a downhole toolstring may include a flow control device configured to receive a fluid from a subterranean formation. The flow control device includes a reciprocating pump having an upper drive unit flowline chamber and a drive unit piston. The flow control device also includes a hydraulic valve system configured to control a flow of a fluid into the upper drive unit flowline chamber. The flow control device further includes a control valve/relief valve (CV/RV) combination disposed between the hydraulic valve system and the upper drive unit flowline chamber. The flow control device also includes a mud valve system configured to control a flow of an injection fluid. The downhole toolstring also includes a control system configured to control flowback of the fluid.

12 Claims, 15 Drawing Sheets

CONTROLLED FLOWBACK FOR STRESS TESTING

CROSS-REFERENCE TO RELATED APPLICATIONS

The present application is a National Stage Entry of International Application No. PCT/US2023/085414, filed on Dec. 21, 2023, that claims priority to U.S. Provisional Patent Application No. 63/476,749 that was filed on Dec. 22, 2022, which is herein incorporated by reference in its entirety.

FIELD OF THE INVENTION

The present disclosure relates to systems and methods for providing controlled flowback of fluids for stress testing in wireline toolstrings.

BACKGROUND INFORMATION

Downhole toolstrings, such as wireline toolstrings, are configured to perform various downhole operations including, but not limited to, deep transient testing, fluid sampling, fluid analysis, and so forth. Conventional flow management control schemes of downhole toolstrings are generally not configured to allow pumping of fluids from high pressure to low pressure due to the fact that mud check valves (MCVs) of the downhole toolstring generally allow flow from high pressure to low pressure without much resistance.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method for controlling flowback of a fluid in a downhole toolstring by receiving flowback of the fluid on a high pressure side of a hydraulic valve system of the downhole toolstring, and slowly decreasing a pressure of the flowback of the fluid in a controlled proportional manner.

For example, certain embodiments of the present disclosure include a method that includes enabling flowback of the fluid into an upper drive unit flowline chamber of a reciprocating pump of the downhole toolstring through a hydraulic valve system and a control valve/relief valve (CV/RV) combination. The method also includes enabling a standby mode of the downhole toolstring during injection of an injection fluid by switching the hydraulic valve system from a first position to a second position. The method further includes, after injection of the injection fluid, turning a motor of the downhole toolstring on to move a drive unit piston of the reciprocating pump upstroke. In addition, the method includes continuing flowback of the fluid with a downstroke of the drive unit piston by switching the hydraulic valve system from the second position to the first position and switching a mud valve system from a third position to a fourth position. The method also includes continuing flowback of the fluid with an upstroke of the drive unit piston.

In addition, certain embodiments of the present disclosure include a downhole toolstring that includes a flow control device configured to receive a fluid from a subterranean formation. The flow control device includes a reciprocating pump having an upper drive unit flowline chamber and a drive unit piston. The flow control device also includes a hydraulic valve system configured to control a flow of a fluid into the upper drive unit flowline chamber. The flow control device further includes a control valve/relief valve (CV/RV) combination disposed between the hydraulic valve system and the upper drive unit flowline chamber. The flow control device also includes a mud valve system configured to control a flow of an injection fluid. The downhole toolstring also includes a control system configured to control flowback of the fluid.

BRIEF DESCRIPTION OF THE DRAWINGS

Various aspects of this disclosure may be better understood upon reading the following detailed description and upon reference to the drawings, in which.

DETAILED DESCRIPTION

Figure 1:
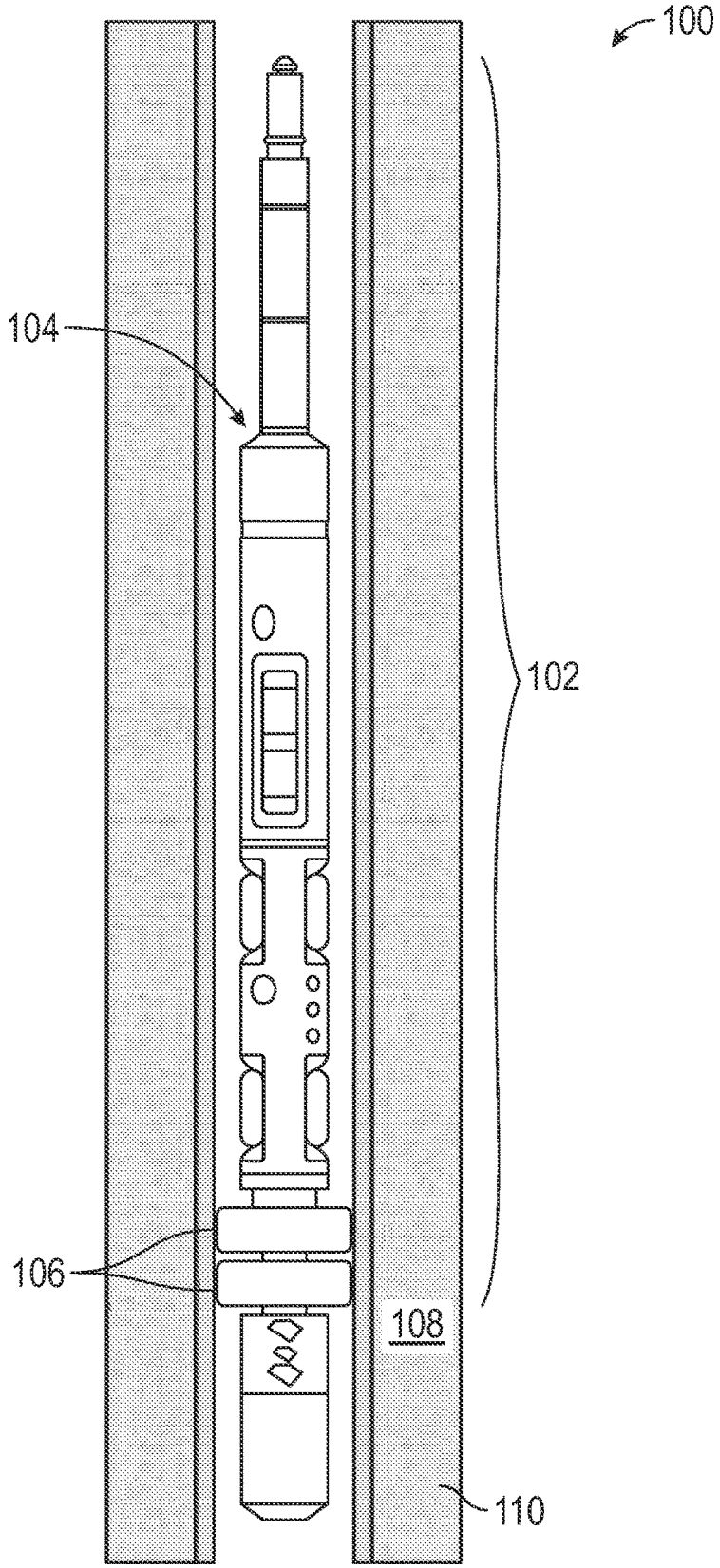
FIG. 1 illustrates a system configured to perform a downhole oil and gas operation, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed or are caused to be performed, for example, by a computing system (i.e., solely by the computing system, without human intervention). Indeed, it will be appreciated that the control system described herein may be configured to perform any and all of the control functions described herein automatically.

In addition, as used herein, the term "substantially similar" may be used to describe values that are different by only a relatively small degree relative to each other. For example, two values that are substantially similar may be values that are within 10% of each other, within 5% of each other, within 3% of each other, within 2% of each other, within 1% of each other, or even within a smaller threshold range, such as within 0.5% of each other or within 0.1% of each other.

Similarly, as used herein, the term "substantially parallel" may be used to define downhole tools, formation layers, and so forth, that have longitudinal axes that are parallel with each other, only deviating from true parallel by a few degrees of each other. For example, a downhole tool that is substantially parallel with a formation layer may be a downhole tool that traverses the formation layer parallel to a boundary of the formation layer, only deviating from true parallel relative to the boundary of the formation layer by less than 5 degrees, less than 3 degrees, less than 2 degrees, less than 1 degree, or even less.

The embodiments described herein include systems and methods for providing controlled flowback of fluids for stress testing in wireline toolstrings, for example, using a bottle with glide sampling. In one or more embodiments, the fluids for stress testing may include any fluid injected into a subterranean formation 110, which may include mud, formation fluid from another zone or interval in the subterranean formation 110, or other fluids of the like, or sample formation fluids extracted from the zone or interval of the subterranean formation 110 to be tested. FIG. 1 illustrates a system 100 configured to perform a downhole oil and gas operation. As illustrated, in certain embodiments, a wireline toolstring 102 may be disposed in a wellbore 104. The wireline toolstring 102 may include a plurality of wireline tools. For example, in certain embodiments, the wireline toolstring 102 may be configured to perform deep transient testing, fluid sampling, fluid analysis, and so forth. In certain embodiments, the wireline toolstring 102 may include digital hardware with cloud-native collaborative software that enables the wireline toolstring 102 to perform such analysis and enable enhanced control of the downhole operations in substantially real time.

As illustrated, in certain embodiments, the wireline toolstring 102 may include one or more packers 106, and the wireline toolstring 102 may be positioned in the wellbore 104 such that one or more packers 106 are adjacent zones of interest 108, such as perforated zones, as illustrated, or open hole zones, fractured zones, or similar zones of a subterranean formation 110 through which the wellbore 104 extends.

In certain embodiments, once the zone of interest 108 is perforated, the wireline toolstring 102 may be conveyed into the wellbore 104 using any suitable means of conveyance including wireline, drill pipes, and so forth. The wireline toolstring 102 may then be lowered to a desired location where the one or more packers 106 are located adjacent the end of the zone of interest 108. The one or more packers 106 may then be set, thereby isolating the zone of interest 108 via the one or more packers 106.

The wireline toolstring 102 may be used to perform wireline operations. The wireline operations can include sampling, downhole fluid analysis, transient testing, and so forth. For example, during sampling, pump modules that are part of the wireline toolstring 102 may be operated to draw fluid into a fluid analyzer of the wireline toolstring 102 from the subterranean formation 110. After completion of the wireline operation, the one or more packers 106 may be deflated and the wireline toolstring 102 may be brought back to surface.

As such, the wireline toolstring 102 may include various flow control devices configured to control the flow of fluids into and through the wireline toolstring 102 to enable the wireline tools of the wireline toolstring 102 to perform deep transient testing, fluid sampling, fluid analysis, and so forth, as described in greater detail herein. Conventional flow management control schemes of downhole toolstrings are generally not configured to allow pumping of fluids from high pressure to low pressure due to the fact that mud check valves (MCVs) of the wireline toolstring 102 generally allow flow from high pressure to low pressure without much resistance. The embodiments described herein introduce various systems and methods to overcome these deficiencies of the conventional flow management control schemes of downhole toolstrings. In particular, the embodiments described herein enable pumping of fluids from high pressure to low pressure by slowly decreasing the pressure of the fluids in a controlled manner, as described in greater detail herein.

Figure 2:
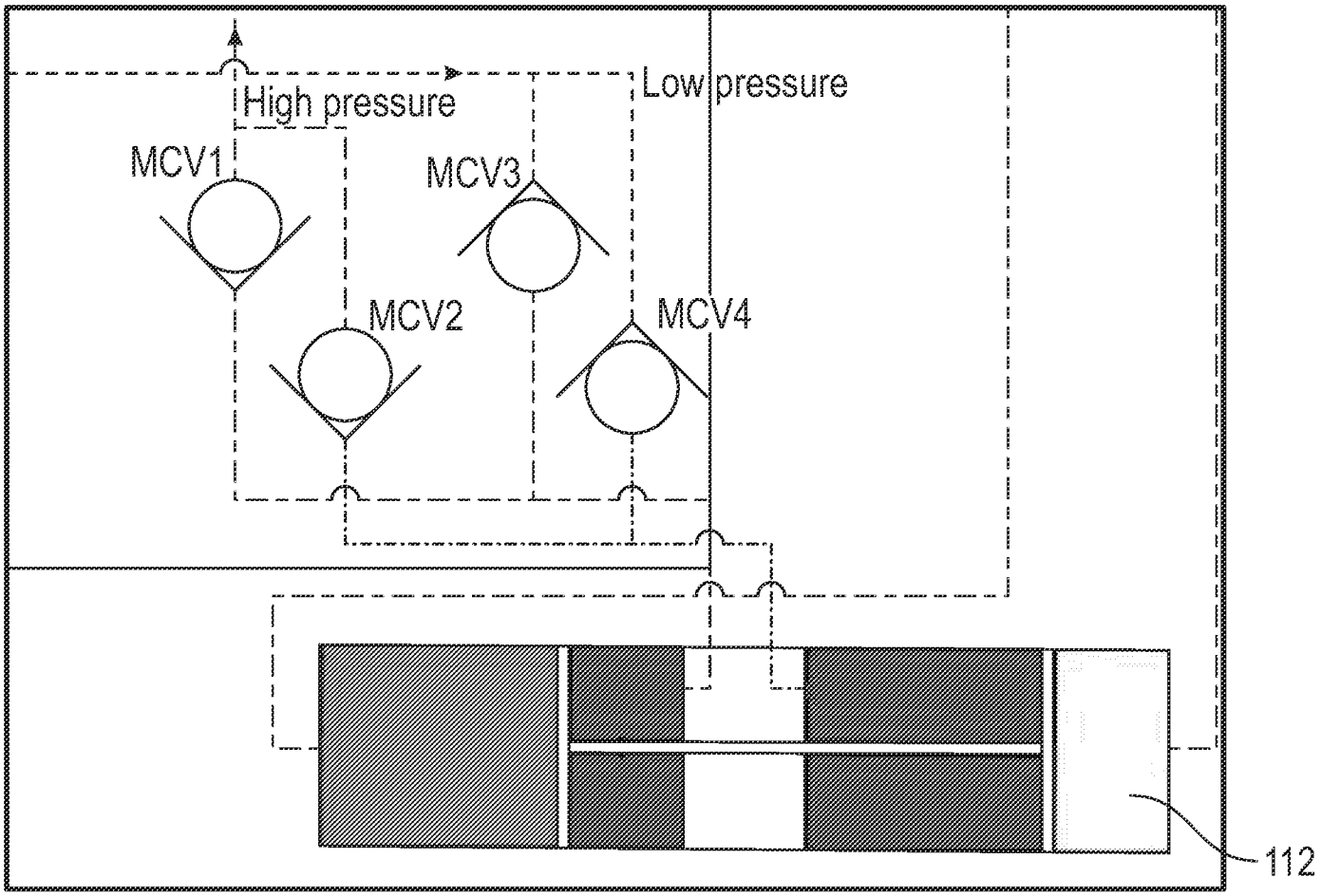
FIG. 2 illustrates certain flow control devices of a wireline toolstring of the system of FIG. 1, in accordance with embodiments of the present disclosure.

As discussed above, conventional flow management control schemes of downhole toolstrings generally only enable pumping of fluids in a controlled manner by a reciprocating pump 112 of the wireline toolstring 102 from high pressure to low pressure, as illustrated in FIG. 2. When high pressure and low pressure are switched as illustrated in FIG. 2, the high pressure will go from MCV3 to MCV1 or MCV4 to MCV2 freely without going through the reciprocating pump 112.

Figure 3:
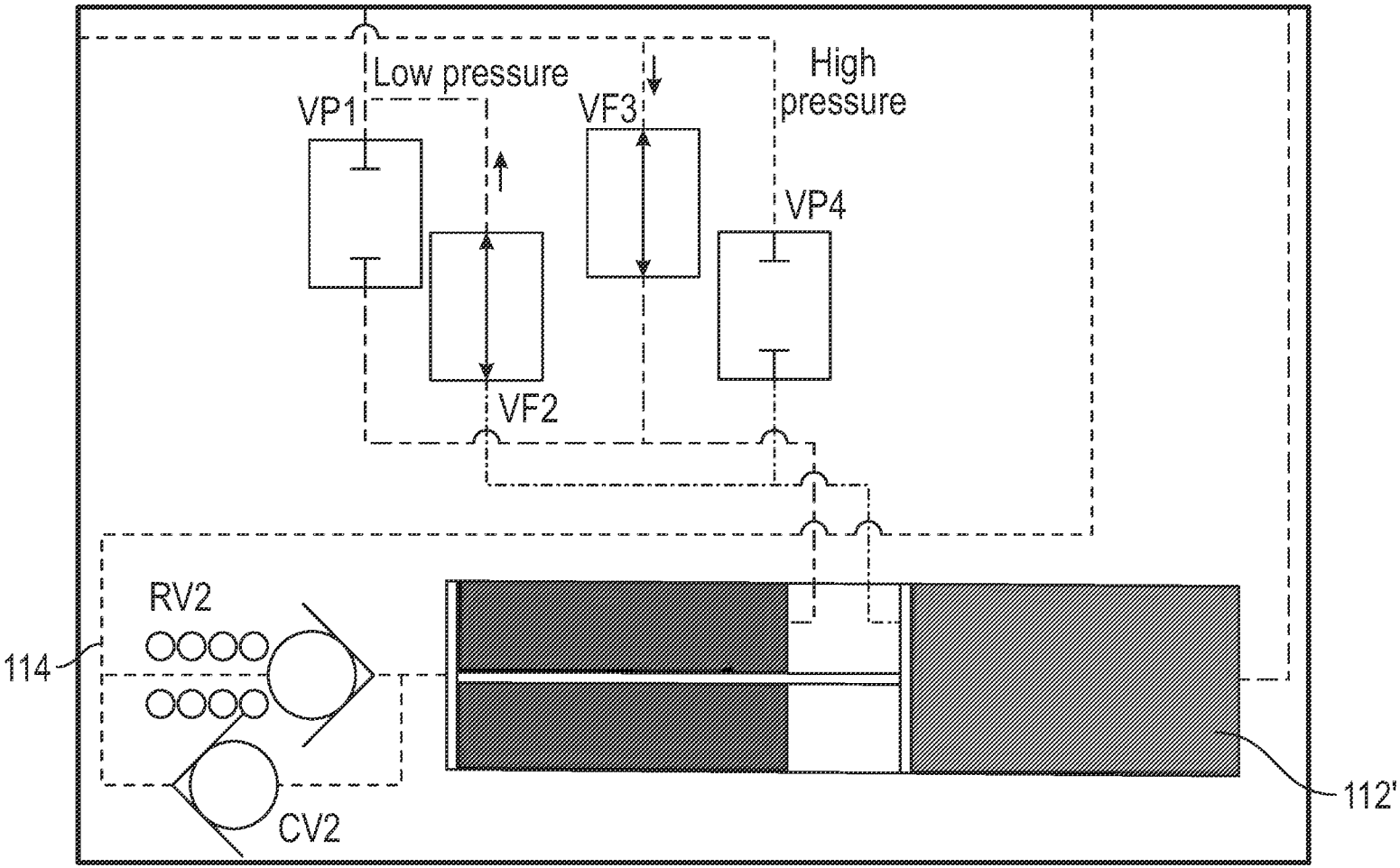
FIG. 3 illustrates alternate flow control devices of the wireline toolstring of FIG. 2, in accordance with embodiments of the present disclosure.

Certain embodiments described herein introduce systems and methods to allow flowback in a controlled manner from high pressure to low pressure by plugging one set of MCVs (e.g., VP1 and VP4) and adding a relief valve RV2 on the drive unit hydraulic control line 114 into the reciprocating pump 112, thereby providing controlled flowback of fluids for stress testing. In other words, to prevent flow of the fluids from high pressure to low pressure, one set of the MCVs (e.g., VP1 and VP4) illustrated in FIG. 2 may be plugged and the other set of MCVs may be replaced by free flow valves (e.g., VF2 and VF3), as illustrated in FIG. 3. Doing so generally blocks flow of the fluids from flowing through the valves without much resistance. Doing so also removes the reciprocating function of the modified pump 112', but the external flow direction control may be used for getting the fluids out of the drive unit chamber. In addition, a control valve/relief valve (CV/RV) combination (e.g., control valve CV2 and relief valve RV2) may be added on the top end of the drive unit hydraulic control line 114 to allow pressure holding in the upper chamber during injection of an injection fluid.

Figure 4C:
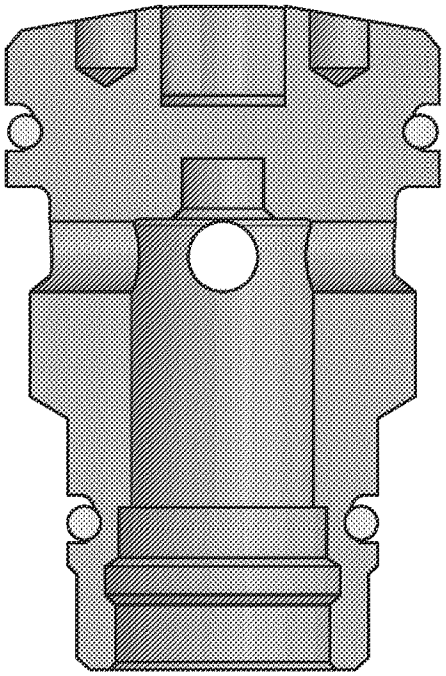
FIGS. 4A, 4B, and 4C illustrate cutaway views of reverse mud check valves (MCVs) of the embodiments illustrated in FIGS. 2 and 3, in accordance with embodiments of the present disclosure.
Figure 4B:
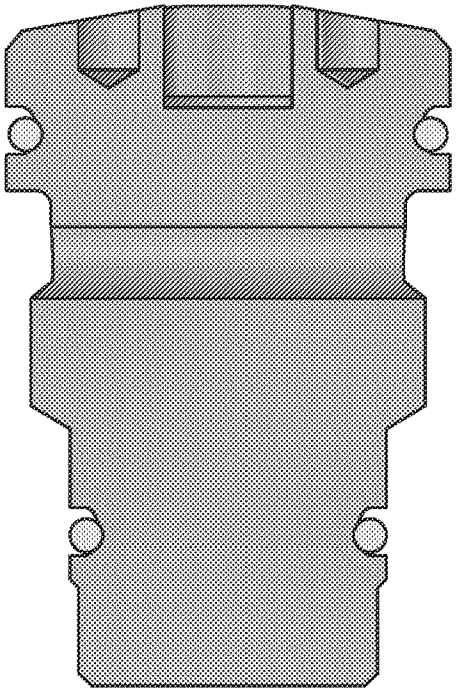
Figure 4A:
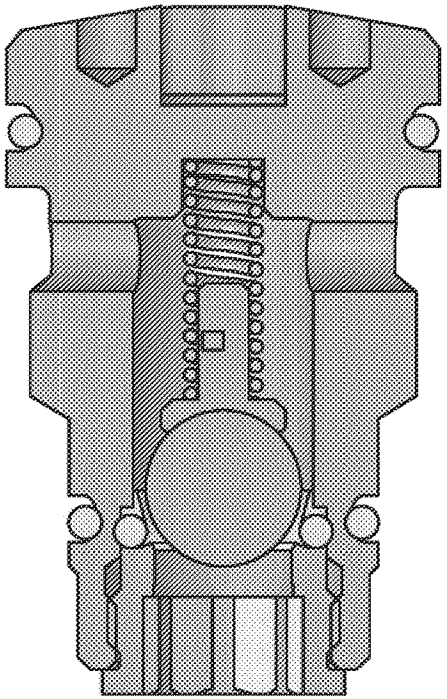
Figure 5C:
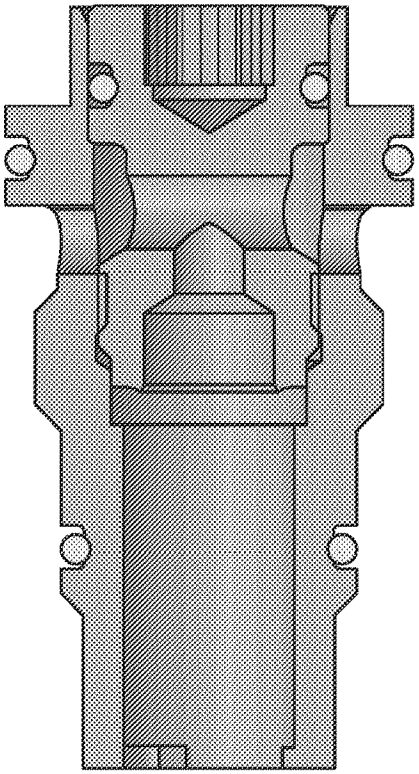
FIGS. 5A, 5B, and 5C illustrate cutaway views of forward MCVs of the embodiments illustrated in FIGS. 2 and 3, in accordance with embodiments of the present disclosure.
Figure 5B:
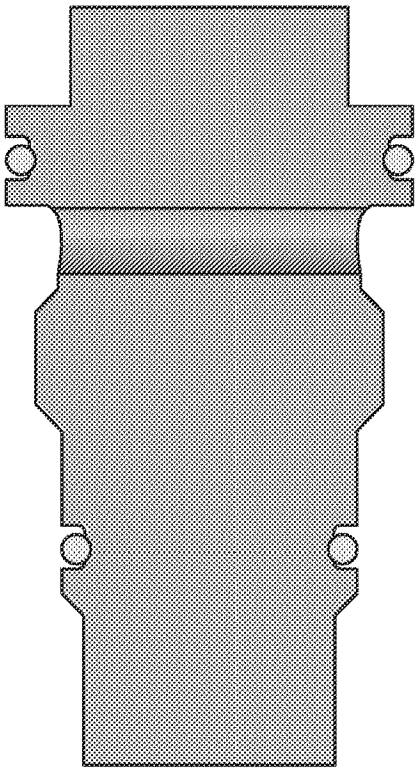
Figure 5A:
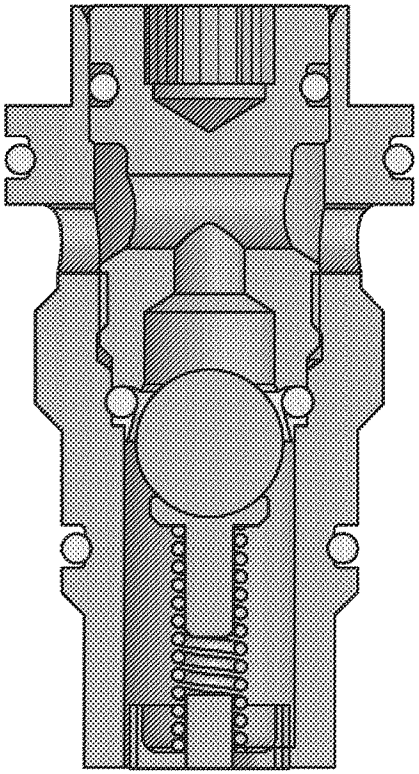
Figure 6:
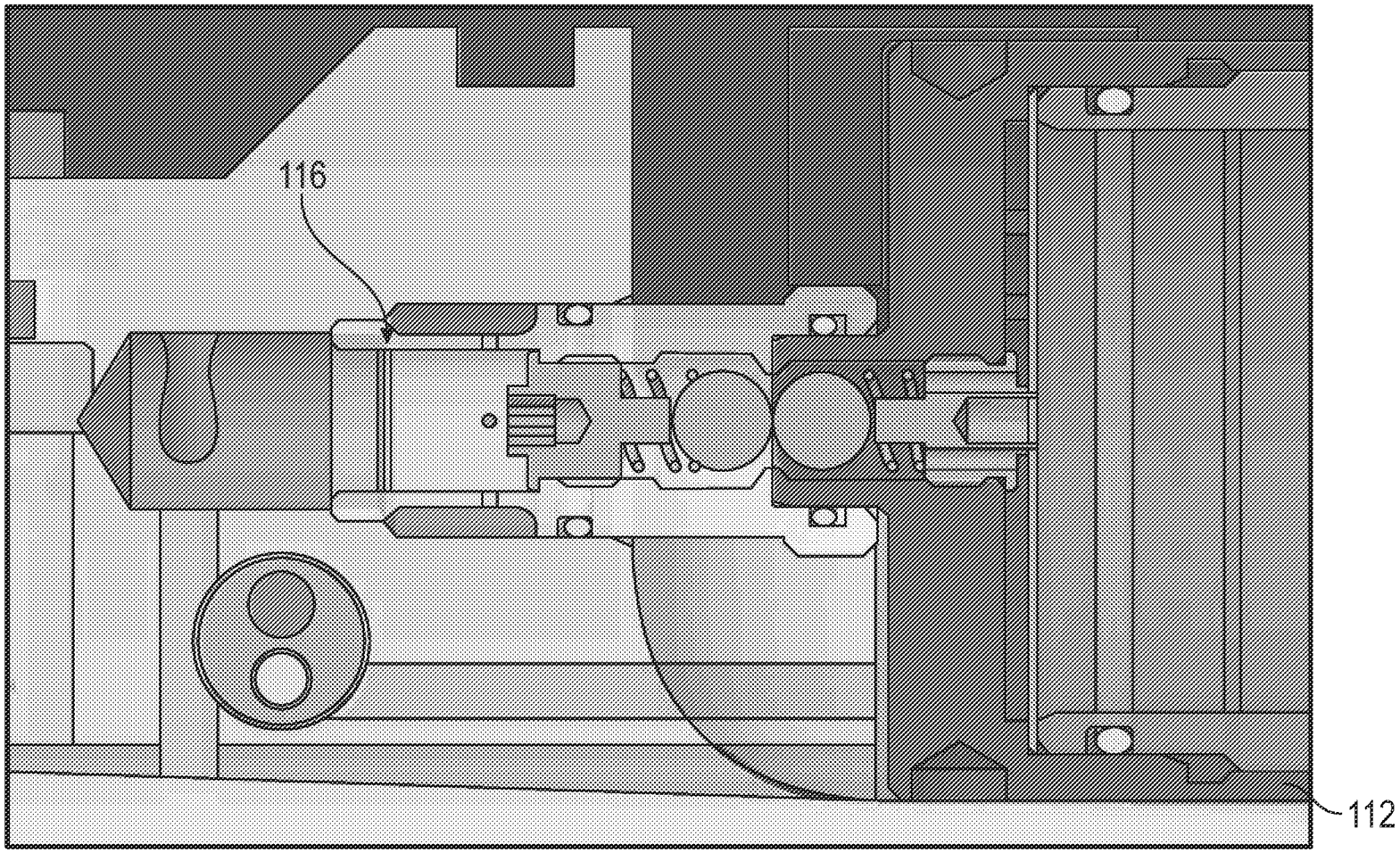
FIG. 6 illustrates a drive unit hydraulic stabber of the embodiment of FIG. 2, in accordance with embodiments of the present disclosure.
Figure 7B:
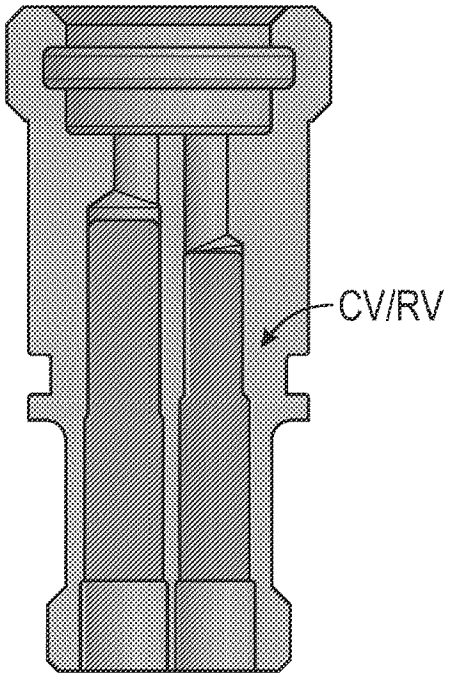
FIG. 7B illustrates the CV/RV combination of the drive unit hydraulic stabber of FIG. 7A, in accordance with embodiments of the present disclosure.

FIGS. 4A, 4B, and 4C illustrate cutaway views of the reverse MCVs, VPs, and VFs, respectively, whereas FIGS. 5A, 5B, and 5C illustrate cutaway views of the forward MCVs, VPs, and VFs of the embodiments illustrated in FIGS. 2 and 3. In addition, FIG. 6 illustrates the drive unit hydraulic stabber 116 of the embodiment of FIG. 2, whereas FIG. 7A illustrates the drive unit hydraulic stabber 116' of the embodiment of FIG. 3, which includes the CV/RV combination illustrated therein (see also FIG. 7B).

Figure 7A:
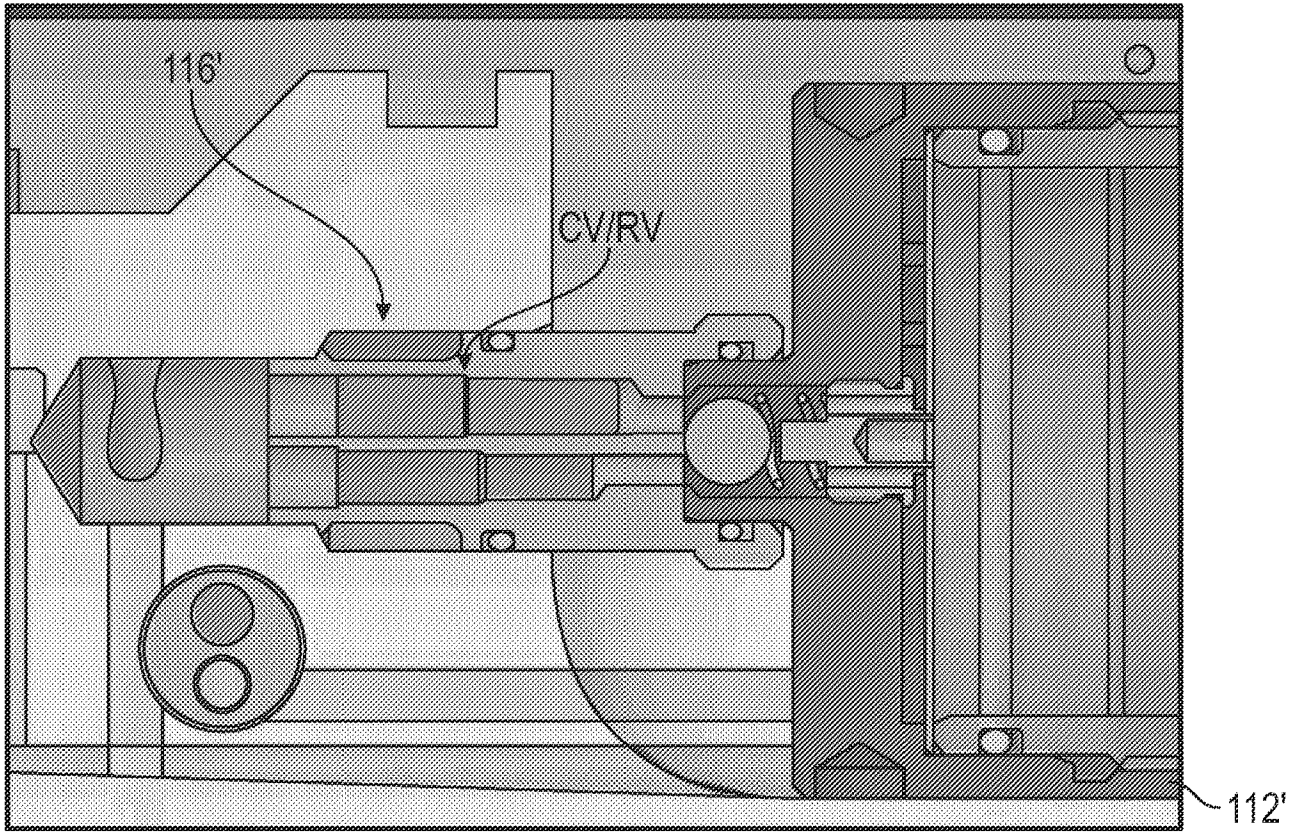
FIG. 7A illustrates a drive unit hydraulic stabber of the embodiment of FIG. 3, which includes a control valve/relief valve (CV/RV) combination, in accordance with embodiments of the present disclosure.
Figure 11:
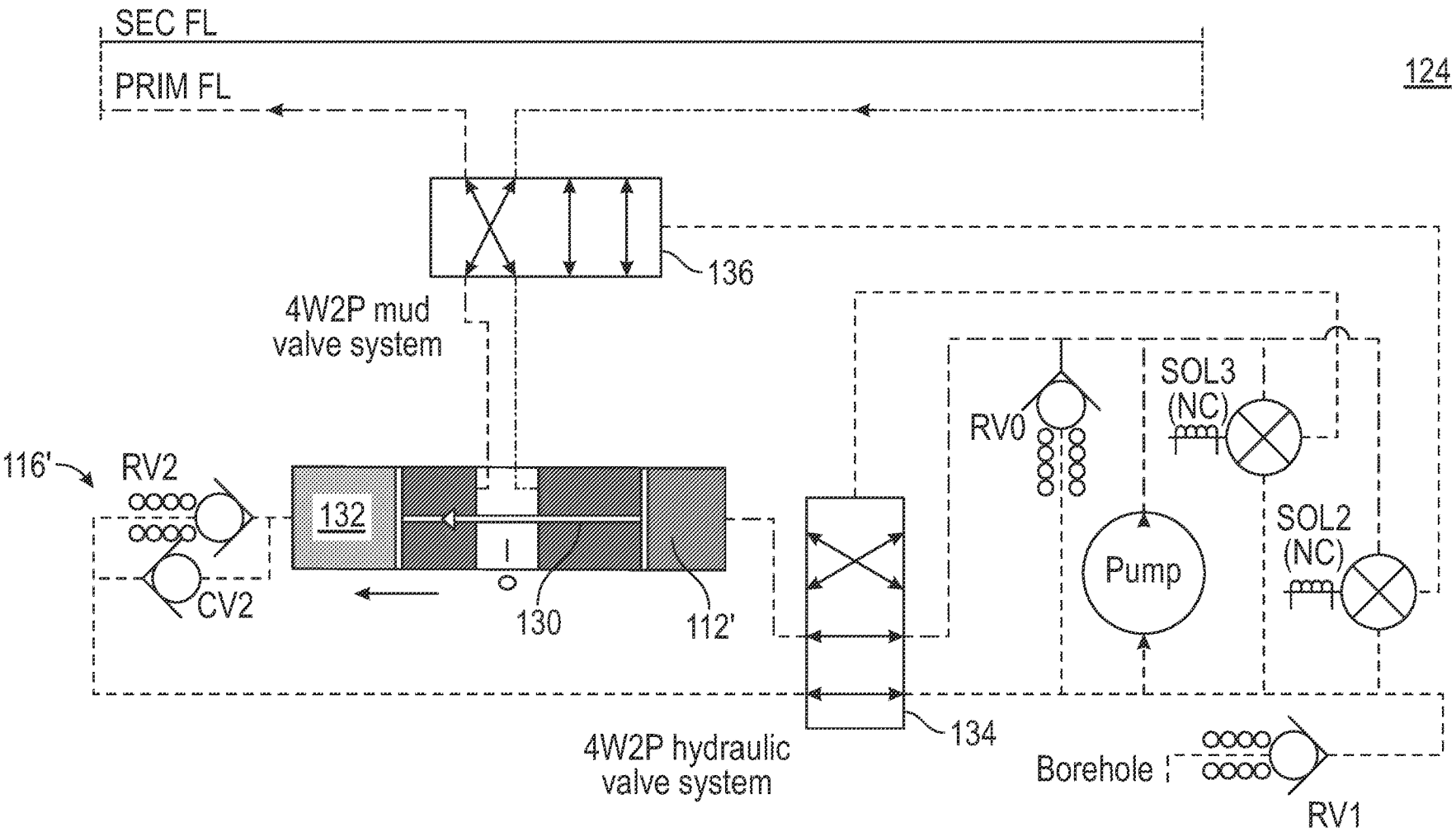
Figure 12:
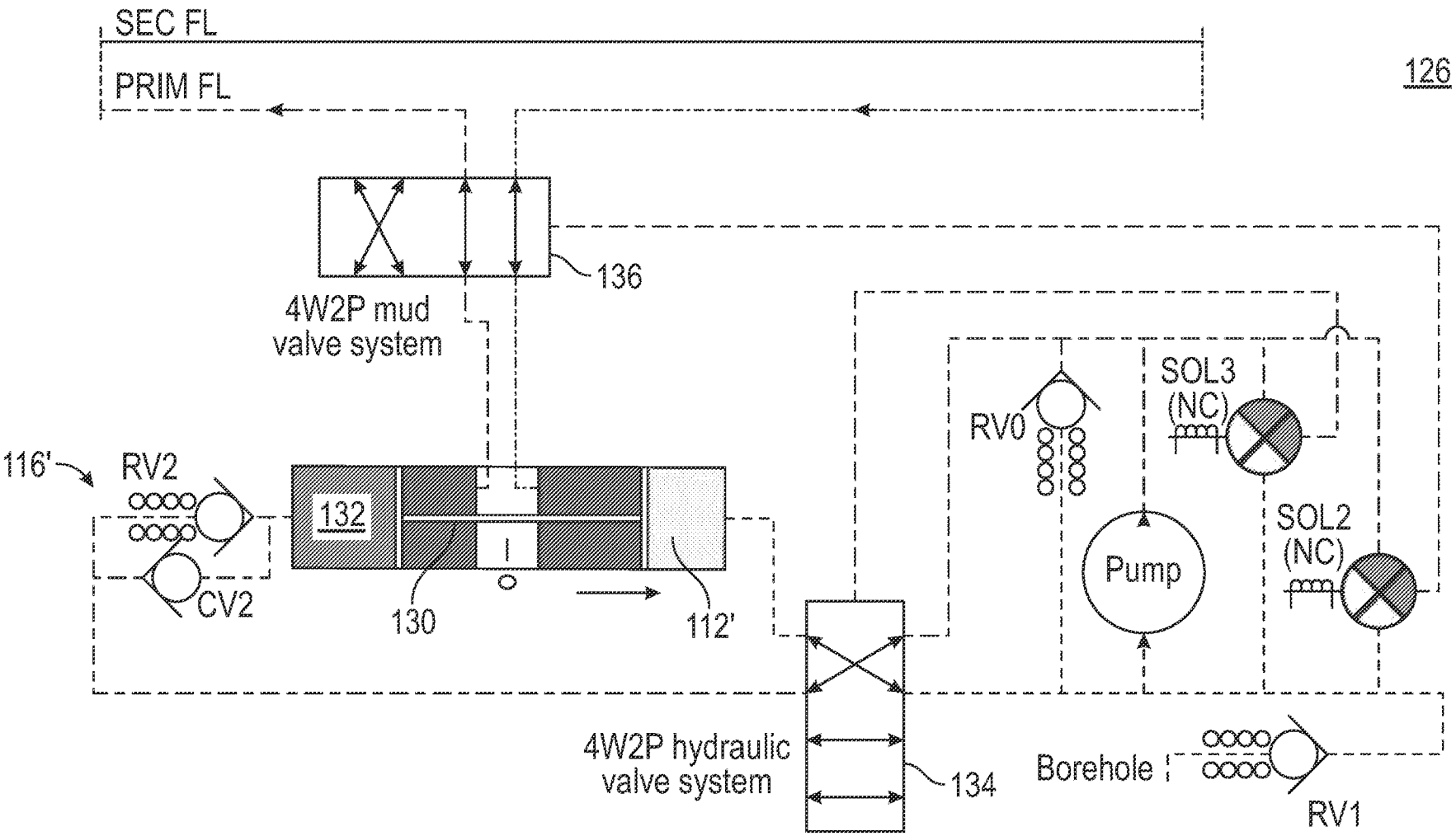
Figure 13:
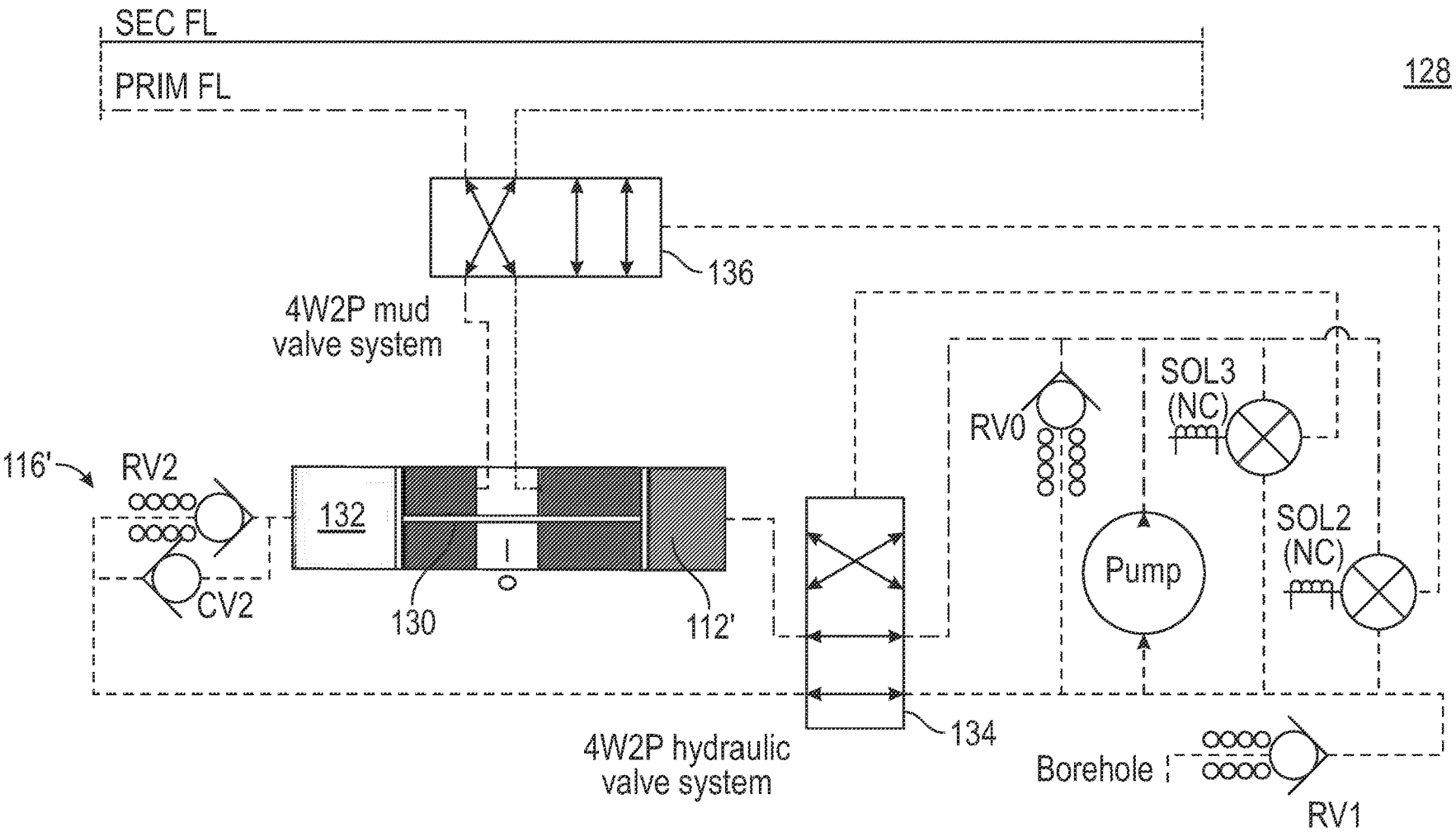

FIG. 8 through 13 illustrate a series of steps of a method to perform controlled flowback with the modified reciprocating pump 112' of the embodiments illustrated in FIGS. 3 and 7A. These steps include: (1) initialization and bypass 118 (FIG. 8), (2) empty drive unit downstroke 120 (FIG. 9), (3) standby during injection 122 (FIG. 10), (4) flowback upstroke 124 (FIG. 11), (5) flowback downstroke 126 (FIG. 12), and (6) finalization 128 (FIG. 13).

Figure 8:
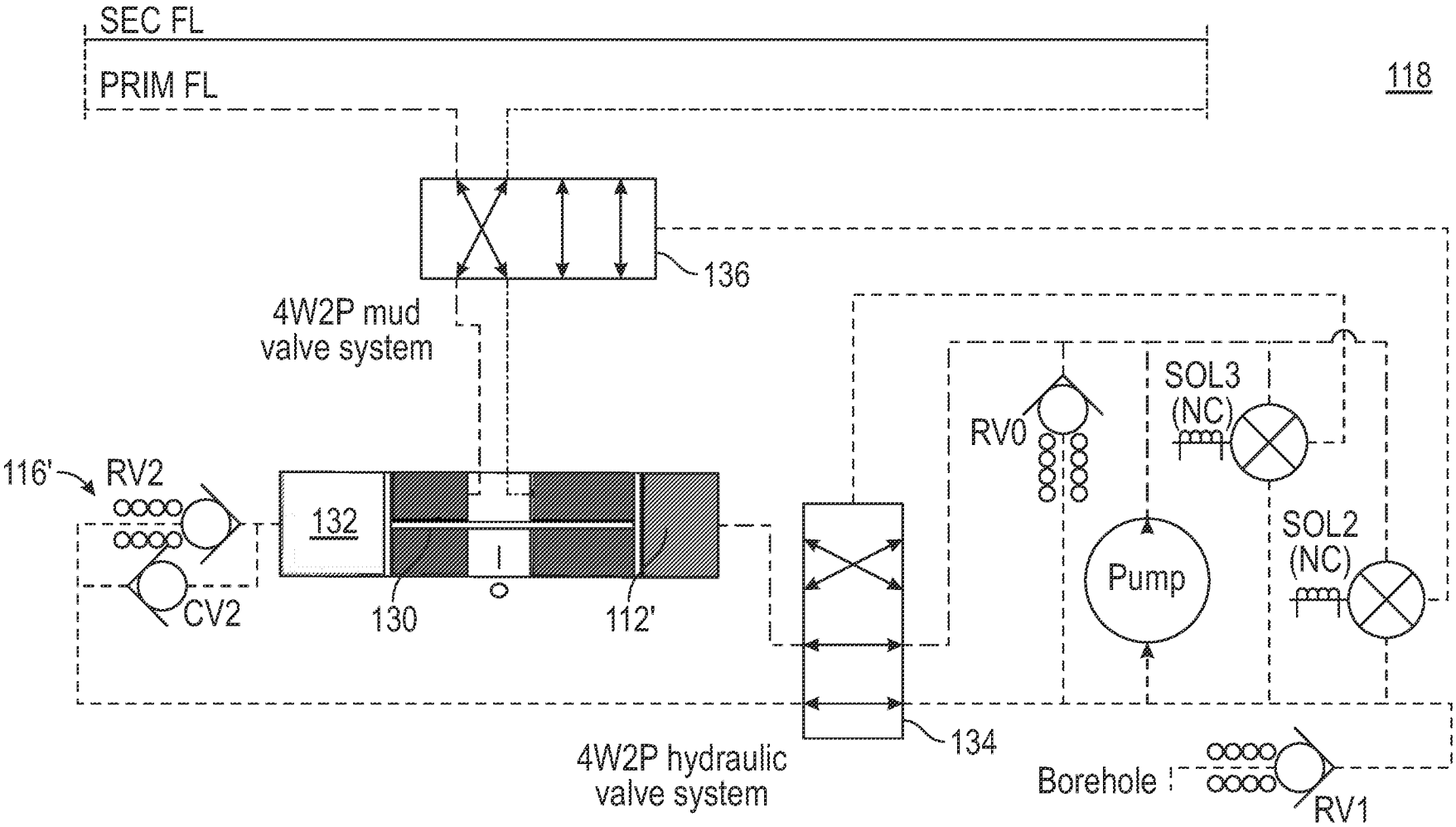
FIGS. 8 through 13 illustrate a series of steps of a method to perform controlled flowback with the modified reciprocating pump of the embodiments illustrated in FIGS. 3 and 7A, in accordance with embodiments of the present disclosure.
Figure 9:
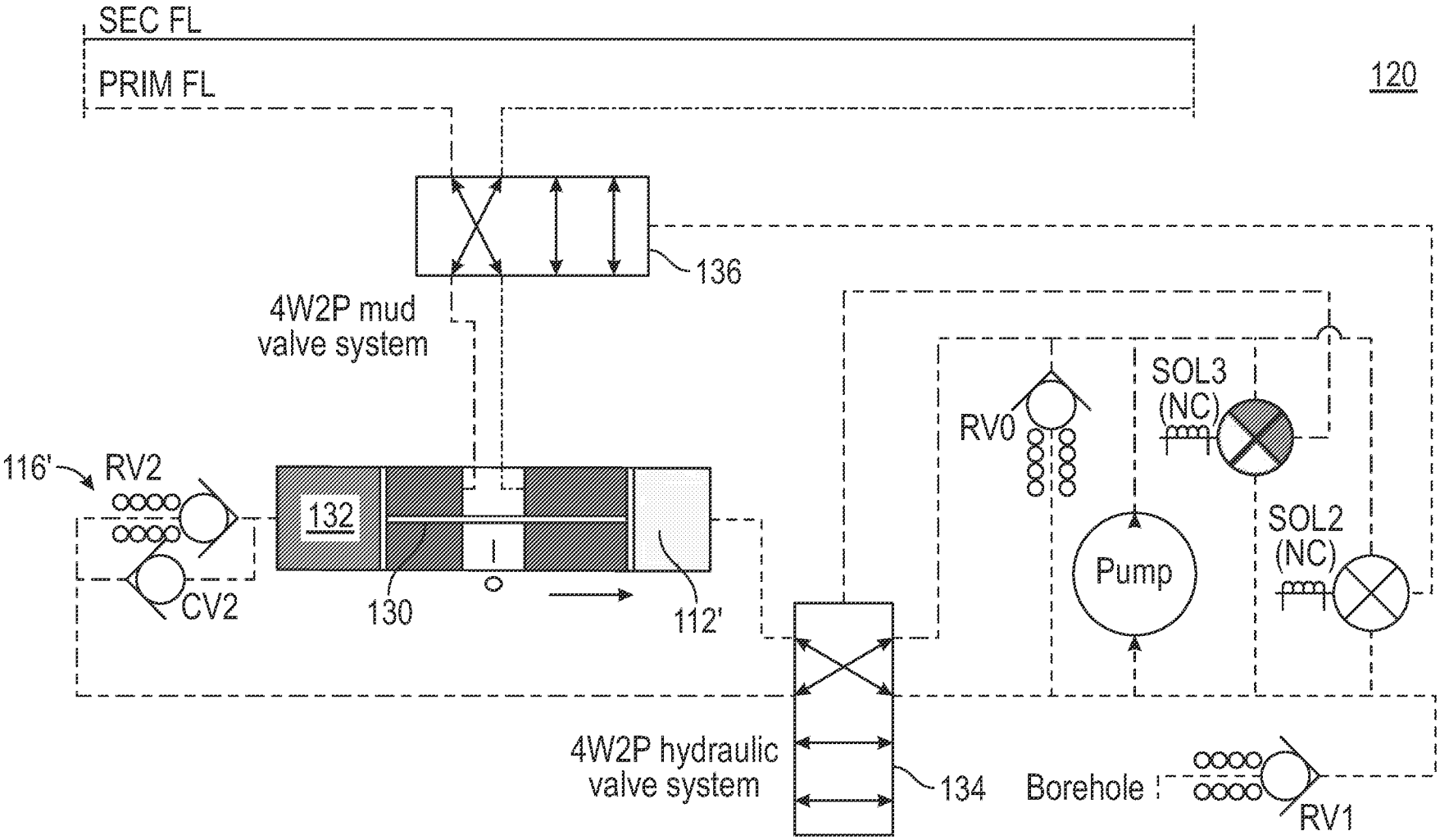
Figure 10:
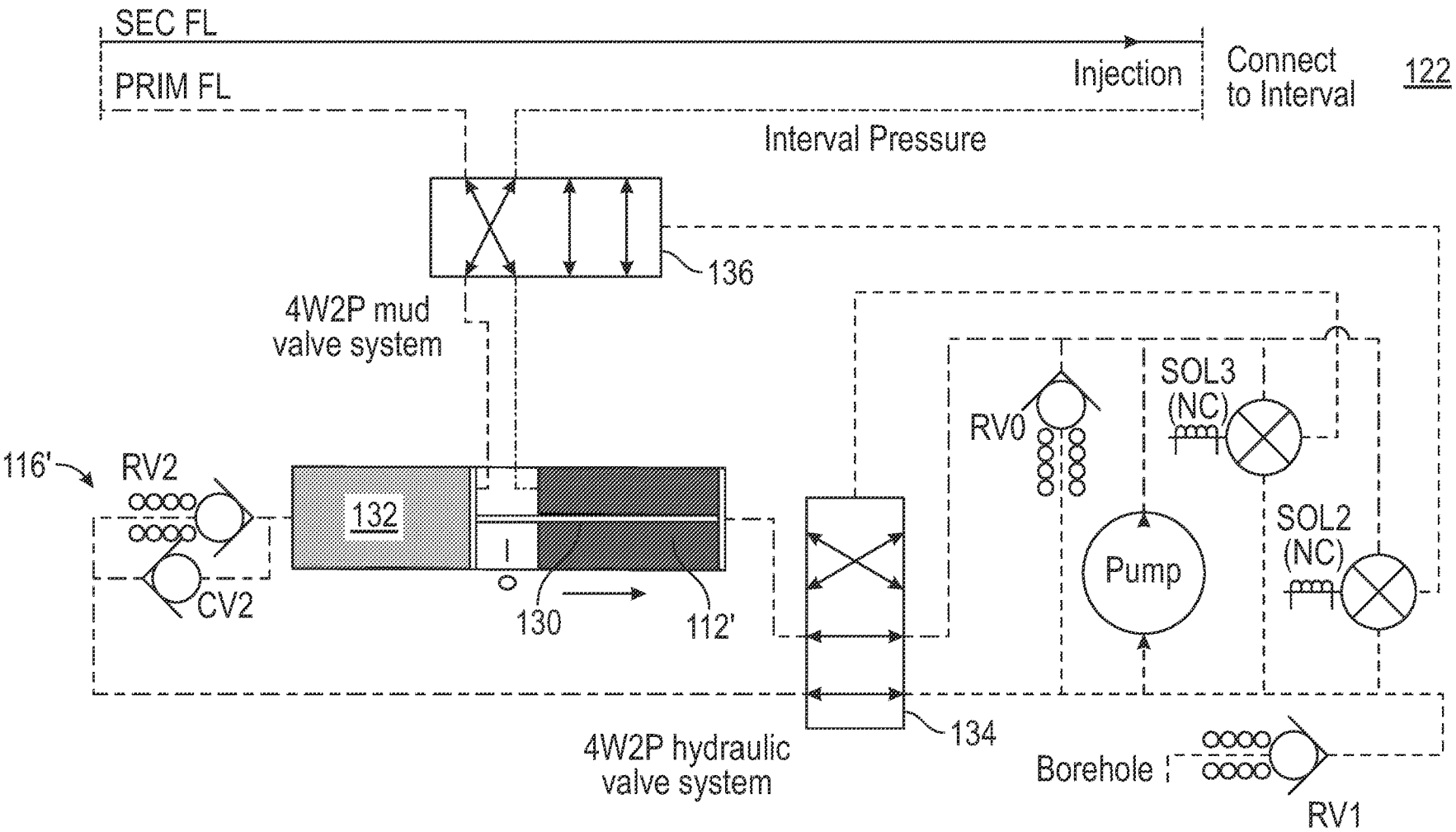

As illustrated in FIG. 8, the method begins with initialization and bypass 118, where solenoids SOL2, SOL3 and the motor of the wireline toolstring 102 are off. Then, as illustrated in FIG. 9, the method continues with an empty drive unit downstroke 120, where solenoid SOL3 is actuated and the motor is run to move the drive unit piston 130 down while leaving the upper drive unit flowline chamber 132 empty to take in flowback of the fluid through a 4-way, 2-position hydraulic valve system 134 and the control valve/relief valve (CV/RV) combination (e.g., control valve CV2 and relief valve RV2) of the drive unit hydraulic stabber 116'. Then, as illustrated in FIG. 10, the method continues with standby during injection 122, where the motor is turned off, solenoid SOL3 is de-actuated, and the 4-way, 2-position hydraulic valve system 134 is switched from a first position to a second position to ensure a PumpUp mode. During injection of the injection fluid, the pressure of the primary flowline (PRIM FL) into the wireline toolstring 102 is connected to the interval pressure and increases with it. At this point, the upper drive unit flowline chamber 132 is connected to the primary flowline (PRIM FL) and the pressure of the upper drive unit flowline chamber 132 is held by relief valve RV2. Then, as illustrated in FIG. 11, after injection of the injection fluid, the method continues with a flowback upstroke 124, where the motor is turned on to move the drive unit piston 130 upstroke. During this step, the speed of the motor may be chosen to allow ideal flow rate of the flowback of the fluid. Then, after the flowback upstroke 124 is completed with deadhead, as illustrated in FIG. 12, the method continues with a flowback downstroke 126, wherein solenoid SOL2 is actuated to ensure a Block mode, the system is moved to a PumpDown mode by switching the 4-way, 2-position hydraulic valve system 134 from the second position to the first position and switching a 4-way, 2-position mud valve system 136 from a third position to a fourth position, then solenoid SOL3 is actuated to continue flowback of the fluid with downstroke. Then, after the downstroke is completed with deadhead, the system is moved to another Block mode, solenoid SOL2 is de-actuated to switch to another PumpDown mode, then solenoid SOL3 is de-actuated to continue flowback of the fluid with upstroke. In certain embodiments, these two steps of the flowback downstroke 126 may be iteratively repeated until flowback is completed. Then, as illustrated in FIG. 13, the method ends with finalization 128, which ensures that there is no trapped pressure in the upper drive unit flowline chamber 132 when the wireline toolstring 102 is brought back up to the surface due to the relief valve RV2. In certain embodiments, after the wireline operation is completed and the one or more packers 106 are deflated, the solenoids SOL2, SOL3 are de-actuated and the drive unit piston 130 is moved with upstroke to deadhead, at which point the motor is turned off.

It has been observed that the method of operation illustrated in FIGS. 8 through 13 present certain advantages and limitations. For example, the advantages include that there is no disturbance of the interval pressure if the flowback of the fluid requires only a first upstroke. In addition, the advantages also include that there is no restriction for injection pressure. In certain embodiments, RV2 may be combined with the rating of the modified reciprocating pump 112' to allow a wide range of flowback pressures and flow rates. However, the limitations include that, to have relatively limited flowback volume, the maximum volume for flowback is 489 cc (cubic centimeters) for a standard drive unit, 202 cc for an 8K drive unit, and 112 cc for a 12K drive unit. Conversely, to have relatively unlimited flowback volume, additional strokes may be needed as described above. However, during switching between PumpDown/PumpUp modes, interval pressure may be disturbed unless complicated control (e.g., ideally automated) is used to ensure pressure in the upper drive unit flowline chamber 132 and the isolation valves ISO1, ISO2, ISO3, ISO4 is the same as the interval pressure before switching between PumpUp and PumpDown modes.

Figure 14:
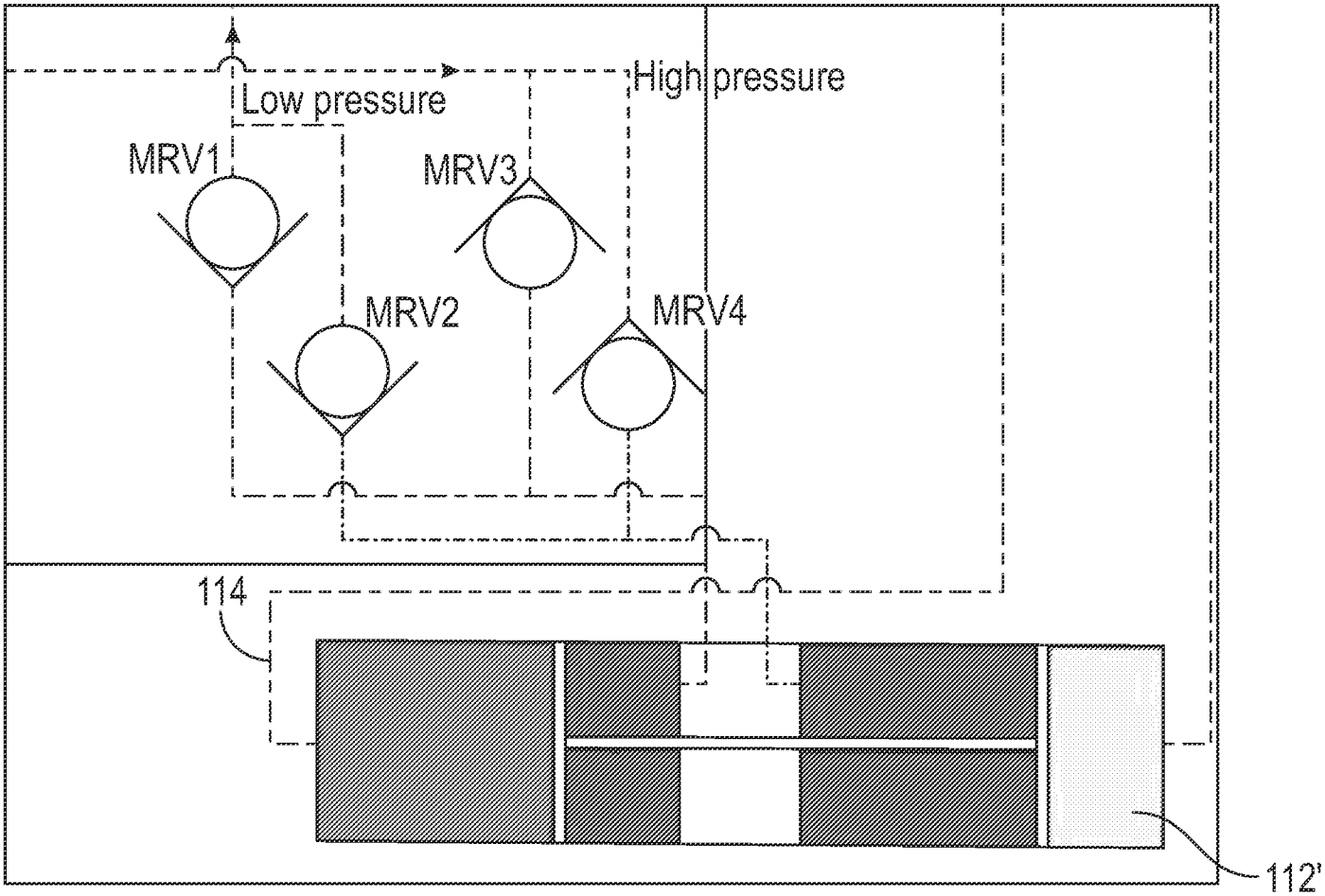
FIG. 14 illustrates alternate flow control devices of the wireline toolstring of FIG. 2, which includes mud relief valves, in accordance with embodiments of the present disclosure.

Other embodiments described herein introduce systems and methods to allow flowback in a controlled manner from high pressure to low pressure by replacing the MCVs (i.e., MCV1, MCV2, MCV3, MCV4) of the embodiment illustrated in FIG. 3 with mud relief valves (i.e., MRV1, MRV2, MRV3, MRV4), as illustrated in FIG. 14. In such embodiments, as long as the pressure differential is lower than the relieving pressure of the MRVs, flow of the fluid may be controlled by the reciprocating pumps LP, SP of the wireline toolstring 102, which results in controlled flowback for stress testing. In other words, as long as the combined relief pressure rating of MRV2 and MRV3 (or MRV1 and MRV4) is higher than the high-low pressure differential, the fluid will not flow through them freely, rather the fluid has to go through the reciprocating pump 112 of the wireline toolstring 102, resulting in controlled flow of the fluid. It will be appreciated that the MRVs illustrated in FIG. 14 may be used as the MCVs and free flow valves (i.e., VP1, VF2, VF3, VP4) of the embodiments illustrated in FIGS. 8 through 13.

In certain embodiments, the direct application of the wireline toolstring 102 described herein may include stress testing. After injection of the injection fluid, relatively high pressure in the interval may be bleed off during flowback. With controlled flowback, formation pressure response may be monitored to analyze various formation properties.

Figure 15:
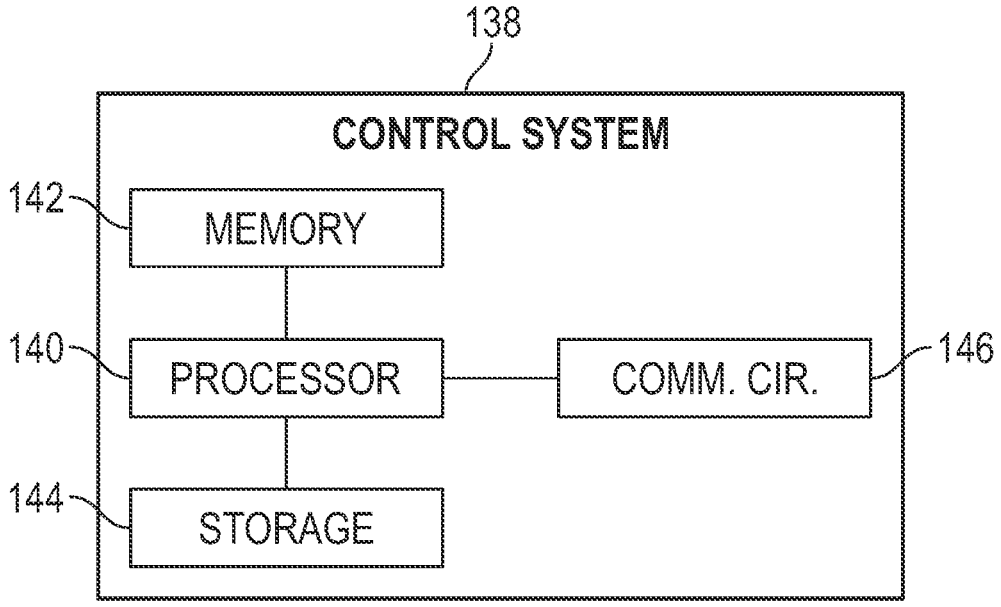
FIG. 15 is a schematic diagram of various components of a control system of the wireline toolstring of FIG. 1.

In addition to the various flow control devices described herein, the wireline toolstring 102 includes a control system 138 configured to control the functionality of the wireline toolstring 102 including, but not limited to, controlling the operating states of the various flow control devices described herein, as well as controlling the various wireline operations performed by the wireline toolstring 102. FIG. 15 is a schematic diagram of various components of the control system 138 of the wireline toolstring 102. As illustrated in FIG. 15, in certain embodiments, the control system 138 may include one or more processor(s) 140, memory media 142, storage media 144, and communication circuitry 146. In certain embodiments, the control system 138 may send control signals to, among other things, the flow control devices of the wireline toolstring 102 to control flowback of fluids flowing through the wireline toolstring 102, as described in greater detail herein. In particular, the processor (s) 140, using instructions stored in the memory media 142 and/or storage media 144, may determine when and how to control operational parameters of the wireline toolstring 102, as described in greater detail herein. As such, the memory media 142 and/or the storage media 144 of the control system 138 may be any suitable article of manufacture that can store the instructions. The memory media 142 and/or the storage media 144 may be read-only memory (ROM), random-access memory (RAM), flash memory, an optical storage medium, or a hard disk drive, to name a few examples. The communication circuitry 146 may be any suitable circuitry configured to enable communication with external systems including, but not limited to, a surface control system, cloud storage, and so forth.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method for controlling flowback of a fluid in a downhole toolstring, the method comprising:

receiving flowback of the fluid via a hydraulic valve system of the downhole toolstring; and decreasing a pressure of the flowback of the fluid, wherein decreasing the pressure of the flowback of the fluid comprises:

(a) enabling the flowback of the fluid into an upper drive unit flowline chamber of a reciprocating pump of the downhole toolstring through the hydraulic valve system and a control valve/relief valve (CV/RV) combination;

(b) enabling a standby mode of the downhole toolstring during injection of an injection fluid by switching the hydraulic valve system from a first position to a second position;

(c) after injection of the injection fluid, moving a drive unit piston of the reciprocating pump upstroke;

(d) continuing flowback of the fluid with a downstroke of the drive unit piston by switching the hydraulic valve system from the second position to the first position and switching a mud valve system from a third position to a fourth position; and (e) continuing flowback of the fluid with an upstroke of the drive unit piston.

2. The method of claim 1, comprising iteratively repeating steps (d) and (e) until flowback of the fluid is completed.

3. The method of claim 1, wherein a pressure of a primary flowline of the downhole toolstring is connected to an interval pressure of the downhole toolstring during injection of the injection fluid.

4. The method of claim 3, wherein the upper drive unit flowline chamber is connected to the primary flowline, and wherein a pressure of the upper drive unit flowline chamber is held by a relief valve of the CV/RV combination.

5. A downhole toolstring, comprising:

a flow control device configured to receive a fluid from a subterranean formation, wherein the flow control device comprises:

a reciprocating pump comprising an upper drive unit flowline chamber and a drive unit piston;

a hydraulic valve system configured to control a flow of the fluid into the upper drive unit flowline chamber;

a control valve/relief valve (CV/RV) combination disposed between the hydraulic valve system and the upper drive unit flowline chamber; and a mud valve system configured to control a flow of an injection fluid; and a control system configured to control flowback of the fluid received from the subterranean formation by:

(a) enabling flowback of the fluid into the upper drive unit flowline chamber through the hydraulic valve system and the CV/RV combination;

(b) enabling a standby mode of the downhole toolstring during injection of the injection fluid by switching the hydraulic valve system from a first position to a second position;

(c) after injection of the injection fluid, moving the drive unit piston of the reciprocating pump upstroke;

(d) continuing flowback of the fluid with a downstroke of the drive unit piston by switching the hydraulic valve system from the second position to the first position and switching the mud valve system from a third position to a fourth position; and (e) continuing flowback of the fluid with an upstroke of the drive unit piston.

6. The downhole toolstring of claim 5, wherein the control system is configured to iteratively repeat steps (d) and (e) until flowback of the fluid is completed.

7. The downhole toolstring of claim 6, wherein a pressure of a primary flowline of the downhole toolstring is connected to an interval pressure of the downhole toolstring during injection.

8. The downhole toolstring of claim 7, wherein the upper drive unit flowline chamber is connected to the primary flowline, and wherein a pressure of the upper drive unit flowline chamber is held by a relief valve of the CV/RV combination.

9. The downhole toolstring of claim 8, wherein a control valve of the CV/RV combination is coupled in parallel with the relief valve of the CV/RV combination.

10. The downhole toolstring of claim 5, wherein the mud valve system comprises plugged valves and free flow valves.

11. The downhole toolstring of claim 5, wherein the mud valve system comprises mud check valves.

12. The downhole toolstring of claim 5, wherein the mud valve system comprises mud relief valves.

* * * * *